US007921471B2

(12) United States Patent
Mordecai et al.

(10) Patent No.: US 7,921,471 B2
(45) Date of Patent: Apr. 12, 2011

(54) PROTECTIVE COAT FOR EMERGENCY RESPONDERS

(75) Inventors: Mark Mordecai, Hampton, NH (US); Julie Snedeker, Northwood, NH (US)

(73) Assignee: Globe Holding Company LLC, Pittsfield, NH (US)

( * ) Notice: Subject to any disclaimer, the term of this patent is extended or adjusted under 35 U.S.C. 154(b) by 312 days.

(21) Appl. No.: 11/627,092

(22) Filed: Jan. 25, 2007

(65) Prior Publication Data

US 2007/0169247 A1 Jul. 26, 2007

Related U.S. Application Data

(60) Provisional application No. 60/762,149, filed on Jan. 25, 2006.

(51) Int. Cl.
*A41D 13/00* (2006.01)

(52) U.S. Cl. ..... 2/98; 2/202

(58) Field of Classification Search ..... 2/129, 81, 2/82, 97, 85, 87, 69, 94, 108, 135, 202
See application file for complete search history.

(56) References Cited

U.S. PATENT DOCUMENTS

| | | | | |
|---|---|---|---|---|
| 2,507,322 | A * | 5/1950 | Smith | 2/97 |
| 2,574,716 | A * | 11/1951 | Spatz | 2/84 |
| 5,406,648 | A * | 4/1995 | Butzer et al. | 2/81 |
| 5,918,314 | A * | 7/1999 | Moses | 2/79 |
| 6,038,700 | A * | 3/2000 | Aldridge et al. | 2/81 |
| 6,339,843 | B1 * | 1/2002 | Grilliot et al. | 2/97 |
| 6,665,878 | B1 * | 12/2003 | Way | 2/84 |
| 6,687,913 | B2 * | 2/2004 | Aldridge | 2/81 |
| 6,978,481 | B2 * | 12/2005 | Mordecai et al. | 2/81 |

* cited by examiner

*Primary Examiner* — Tejash Patel
(74) *Attorney, Agent, or Firm* — Finch & Maloney PLLC

(57) ABSTRACT

A coat for use by emergency responders, such as firefighters, is described. Certain aspects of the coat include a barrier resistant liner for protection against chemical and biological agents, a compression zone that can improve safety when working in hazardous areas, and a flame resistant shell including zippered sleeves that can facilitate the donning of protective gloves.

14 Claims, 16 Drawing Sheets

PROTECTIVE COAT FOR EMERGENCY RESPONDERS

RELATED APPLICATION

This application claims benefit of U.S. Provisional Patent Application Ser. No. 60/762,149, titled "PROTECTIVE COAT FOR EMERGENCY RESPONDERS" filed Jan. 25, 2006 and which is hereby incorporated by reference herein.

BACKGROUND OF INVENTION

1. Field of Invention

The invention relates to garments for emergency responders such as firefighters, and, in particular, to a coat for responders potentially exposed to chemical and/or biological hazards.

2. Discussion of Related Art

The field of the emergency response has become broader and of greater importance in the past several years. Emergency responders, such as firefighters, EMTs, policemen, civil defense workers and defense workers now need to be prepared for hazards beyond fires, floods, and conventional warfare. Firefighters can be well protected against flame, heat and water by firefighter apparel that includes waterproof and thermal layers, such as those described in U.S. Pat. No. 5,884,332 to Snedeker, which is incorporated by reference herein. Responders may now need to respond to incidents where it is important to be protected not only against flame, heat and water, but against toxic chemicals, chemical warfare agents and biological pathogens. These hazardous substances may be present in the form of solids, liquids, aerosols, vapors or gases and therefore may bypass the protection provided by conventional firefighter apparel that is typically designed to protect against flame, heat, and water.

SUMMARY OF INVENTION

In one aspect, the invention provides a resistant barrier coat for protecting against chemical and/or biological hazards, the coat comprising a flame and abrasion resistant outer shell, the outer shell including a torso portion, two sleeve portions and a collar portion, a resistant barrier liner including a torso portion, two sleeve portions, a collar portion, and an integral hood, and a fastener constructed and arranged for connecting the collar portion of the resistant barrier liner to the collar portion of the outer shell.

In another aspect, a resistant barrier liner for use as part of an emergency responder's coat is provided, the liner comprising a breathable resistant barrier layer, an integrated hood, and a fastener for removably retaining the resistant barrier within an outer shell of the coat.

In another aspect, a method of donning an emergency responder's coat for protection against chemical and/or biological contact, the coat including an outer shell and an inner resistant barrier liner including a concealed hood, the method comprising disconnecting the inner barrier resistant liner from the outer shell, exposing the previously concealed hood, covering a portion of the responder's head with the hood, and forming a liquid/vapor resistant seal between the hood portion and a SCBA facemask.

In another aspect, a resistant barrier liner for use with an emergency responder's coat is provided, the liner comprising a torso portion joined to two arm sleeves wherein the torso portion includes a compression zone whereby volume inside the torso portion can be reduced by tightening the compression zone.

In another aspect, a coat for an emergency responder is provided, the coat comprising a water resistant layer and a flame resistant outer shell including two sleeves, each sleeve including a slit running from a wrist opening to a point at least half way to the elbow, wherein the slit is closable via a fastener.

In another aspect, a firefighter's ensemble is provided that complies with at least one of NFPA Standards 1951, 1971, 1992, 1999, and 1994, the ensemble comprising at least one of the coats or liners summarized above.

The subject matter of this application may involve, in some cases, interrelated products, alternative solutions to a particular problem, and/or a plurality of different uses of a single system or article.

BRIEF DESCRIPTION OF DRAWINGS

In the drawings, different embodiments of the invention are illustrated in which.

DETAILED DESCRIPTION

Figure 1:
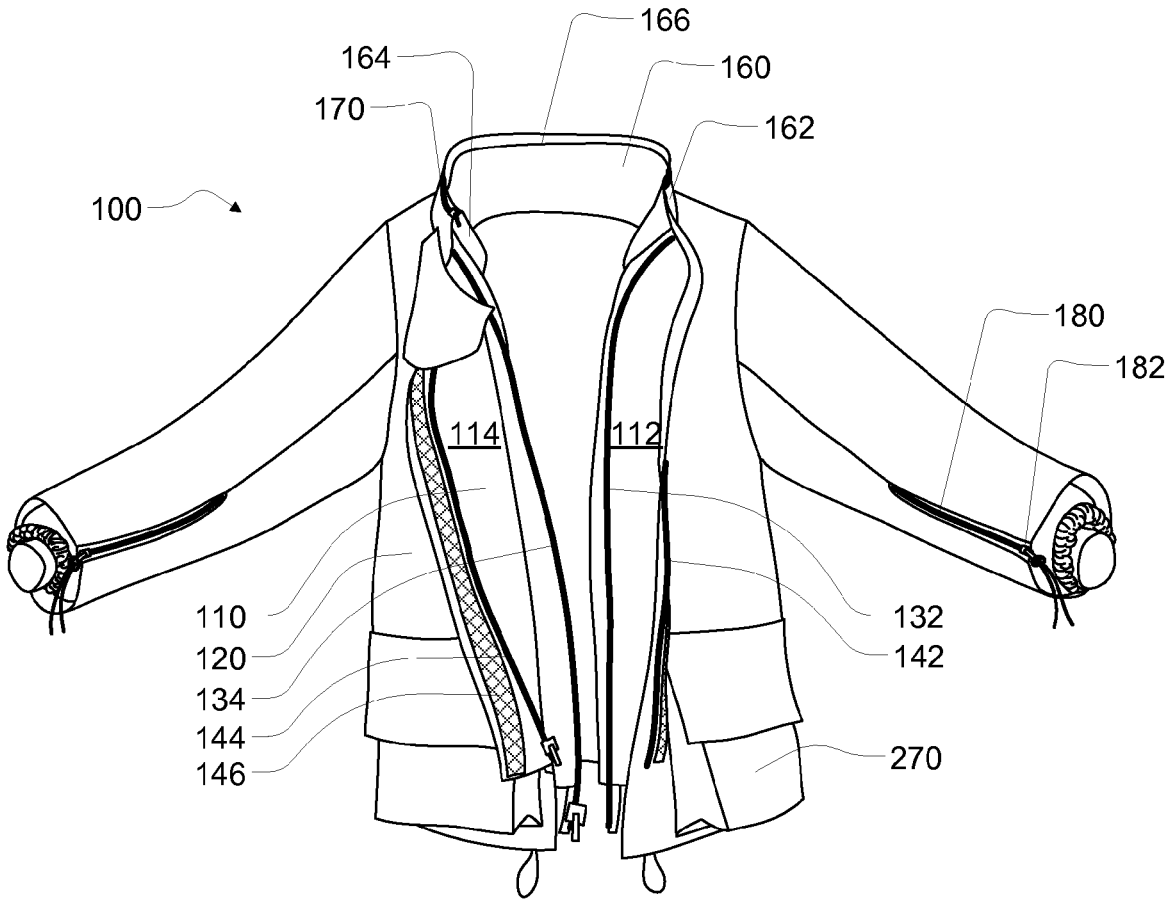
FIG. 1 provides a frontal view of a responder's coat.

Exposure to hazardous substances, such as chemical, biological or radiological agents, even minimal exposure, can be fatal or cause permanent injury. Apparel and equipment currently exist that are capable or partially capable of protecting a responder against these hazards, but in many cases, the apparel, which may be an impermeable full body suit, may be uncomfortable and difficult or impossible to work in under some conditions. Furthermore, these protective suits may be of limited utility in responding to conventional fires or medical emergencies as their durability may be limited. Such garments are described, for example, in U.S. Pat. No. 5,948,708 to Langley.

These hazardous materials (hazmat) suits may limit mobility and may hamper a responder's ability to operate under emergency conditions. They typically do not provide protection from flame and/or heat. In addition, the lack of comfort that is typically experienced in using these types of protective suits means that responders are unlikely to don this protection until they are specifically called to respond to an unconventional event. Consequently, the emergency responder's ability to quickly rescue ambulatory victims or to escape from such an event with appropriate protection is compromised.

Firefighters and other emergency responders are generally confident and comfortable in traditional firefighter ensembles that typically include separate trousers, coats, gloves and boots. These ensembles can be donned conventionally and firefighters are familiar with their use and care. Traditional ensembles however may not provide adequate protection against harmful substances such as chemical agents and biological pathogens that are now in the forefront of concern.

The inventors have perceived a need for apparel that can provide comprehensive protection against chemical and biological hazards (for example, meet the requirements of NFPA standard 1971) and is more comfortable and user-friendly than currently available hazmat suits. Disclosed herein is a garment system that, among many aspects, provides the comfort and convenience of a traditional two piece firefighter suit while providing the biological and chemical protection of a hazmat ensemble.

In one aspect, the invention provides a coat for protecting emergency responders against biological and chemical agents. The coat may include a liner comprising a resistant barrier layer with an integral hood that can be concealed when not required.

In another aspect a coat is provided that includes a liner having a resistant barrier layer that includes a mechanism for reducing the air space inside the liner and therefore eliminating or reducing the "bellows effect."

In another aspect, a resistant barrier liner is provided that may be used in conjunction with an outer shell of flame and abrasion resistant material. The liner may float independently inside the outer shell, protecting the wearer against hazardous substances.

In another aspect, an outer shell of an emergency responder's coat includes sleeves with slits extending from the cuffs toward the elbow. The slits, typically sealed with a zipper, allow the sleeve to be opened up to facilitate the donning of gloves.

"Selectively Permeable" describes a material that allows the passage of some substances while preventing the passage of others.

"Vapor/liquid Resistant" means that a material with this property can prevent entry of undesirable vapors and/or liquids and/or aerosols. It may be impermeable or semi-permeable to some substances, such as water vapor.

"Resistant barrier layer" means a layer that prevents the passage of a hazardous substance such as a chemical agent or a biological pathogen.

"Water Vapor Permeable" describes a material that is substantially impervious to liquid water but can allow the passage of water vapor at a rate of at least 100 $g/m^2/day$.

The invention includes a coat for use by firefighters or other emergency responders when the wearer may be exposed to hazardous substances such as chemical agents or biological pathogens. While the coat may consist of multiple layers, such as an outer shell and an inner thermal layer, the layer providing maximum protection against hazardous vapors, liquids and aerosols is typically an inner barrier liner that includes a resistant barrier layer that is substantially impervious to vapors, aerosols and liquids while, preferably, allowing water vapor to pass out of the liner. This breathability can allow for the transmission of water vapor from inside the liner out to the environment, providing greater comfort for the wearer whose physical activity and work conditions may produce much perspiration.

Materials may be chosen so that the coat or ensemble complies with one or more of NFPA Standards 1951, 1971, 1992, 1999, and 1994. Specifically, in some embodiments, the combination trousers and boots may form part of an ensemble that passes the "Man In Simulant Test" to meet the CBRN option of NFPA 1971. Some compounds and biological pathogens that may be specifically protected against include, for example, methyl salicylate, nerve agents, mustard gas, phosgene, sarin, viruses and pathogenic bacteria such as anthrax. The apparel may also prevent the transmission of radioactive particulates or aerosols.

Much of the description herein is directed to the resistant barrier liner but it is understood that the liner may be used independently as a jacket or with other layers such as an outer shell and/or an inner thermal layer to provide a coat suitable for use by firefighters and other emergency responders. The coat may be part of an ensemble that includes, for example, trousers, boots, gloves and/or SCBA equipment to provide for complete body protection of the responder. For example, the ensemble may include trousers such as those described in U.S. patent application Ser. No. 11/615,262, titled PROTECTIVE APPAREL FOR FIREFIGHTERS AND EMERGENCY RESPONDERS. The lower portion of the coat may overlap the trousers which may include a trouser extension above the waist. The seal between the coat and trousers can be secured by the waist belt of the SCBA apparatus which may surround the wearer around a section covered by layers of both the coat and the trousers.

In one embodiment, the resistant barrier liner includes a hood that may be integral to or detachable from the liner. The hood may comprise the same material as the liner and may prevent hazardous substances from contacting the wearer's head. The hood need not be breathable but can be in some embodiments. The liner may take the form of a coat including a torso section with left and right sleeves and a zipper or other fastener for securely joining left and right front panels. The fastener may extend the full length of the garment from hood to the waist allowing the liner to be donned like a coat. In other cases, the fastener may extend for only a portion of the garment and the garment can be donned as a pullover, after which the fastener can be secured to fully close up the liner. The hood, when not required, may be stored out of sight in space between the liner and an outer shell. In many cases, a responder may not need to be outfitted for protection against hazardous materials and in these cases the hood may remain undeployed, resulting in a firefighter's suit that provides protection against that traditional hazards of flame, heat and water.

Conventional jackets and coats that include a stowable hood typically mount the hood inside of the collar or mount the collar above and behind the hood so that the hood can be folded back into a pouch that lies in or behind the collar. The liner described herein, however, may include a collar that is fastened entirely or substantially to the interior, rather than the exterior, of the neck area of the liner. Thus, when the hood is deployed, the rear portion of the collar may be inside the hood/liner and may not be visible to an observer. In some embodiments the liner collar can remain in contact with the responder's neck when the hood is either deployed or undeployed.

The collar may include a fastener (or half fastener) along or near its perimeter. This fastener may be mated with another fastener that is connected to a collar portion of an outer shell. For example, the liner collar may include one half of a zipper and the shell collar may include the complementary half of the zipper. When the liner collar is mounted on the inside surface of the liner, the hood may be pushed down into a space between the liner and the shell before the two zipper halves are joined. Once joined, the shell collar and liner collar become a single unit, a composite collar, providing the appearance of a single coat collar. In some embodiments, the portion of the liner collar that faces inwardly and contacts the wearer's skin may include a material chosen for comfort, e.g., synthetic fleece or other fabric, woven or non-woven, chosen to avoid irritation and to be comfortable. As the shell collar typically does not remain in contact with the wearer's skin, the shell collar need not include a material chosen for comfort against the skin. In some embodiments, the only point of attachment between the liner and the outer shell is the collar zipper. In these cases, when the hood is deployed, the liner may not be attached to the shell and can become a "floating liner." If desired, the liner may be donned by the responder prior to donning the outer shell, and the shell may be removed by the responder without removing the liner.

In other embodiments, the liner may be attached to the outer shell at the sleeves. For example, the liner can be permanently (eg, sewn) or temporarily (eg, zipper) attached to the sleeve. Attachment at the sleeves may or may not be accompanied by attachment at the collar. If permanently attached at the sleeves, the liner is not a floating liner. In this case, the liner and the outer shell to which the liner is permanently attached may function as a single garment and may be donned and removed as one.

In another aspect, a liner for an emergency responder's coat includes a region with a compression zone. The compression zone helps to reduce the "bellows effect" that can occur when the wearer moves in hazardous conditions. For a variety of reasons including ease of use, comfort, and manufacturing standards, coat components are typically cut to provide space between the inner surface of the liner and the body of the wearer. This space may allow for greater movement and comfort, however, it also provides an air cavity inside the liner that may change in size and/or position when the wearer moves. These movements, e.g. bending, twisting, running, etc, can result in alternate expulsion and admission of air (the bellows effect) from the air space between the liner and the wearer's body. Unfortunately, when working in a hazardous environment this air may be contaminated with hazardous chemicals, aerosols, or biological agents. Thus, the responder's movement can result in the introduction of hazardous materials inside the protective liner.

One or more compression zones in the liner can help to reduce or eliminate the bellows effect. A compression zone can allow for a temporary or permanent reduction in the volume of the liner by tightening or restricting particular portions of the liner. The compression zone may include any mechanism that allows for a tightening or constriction of one or more portions of the liner that provides for a reduction in the volume of the liner. Typically this will result in a reduction in space between the liner and the wearer's body. Preferably, a compression zone is positioned in an area where the greatest reduction in volume can take place. For example, in some embodiments compression zones may be placed proximal to the kidney area, above the waist and below the armpits. In a preferred embodiment a liner includes two compression zones, one on the left and one on the right side of the torso. A compression zone may encompass a thermal layer as well.

Compression, or tightening, may be accomplished by any mechanism capable of reducing the volume of the liner. These mechanisms include, for example, hook and loop fasteners, snaps, buttons or zippers. In one embodiment, a lace and eyelet design may be employed. The region can be compressed by tightening the laces and as a result decreasing the distance between eyelets through which the laces run. Laces can be tightened manually and kept in a tightened position by, for example, tying or securing with slide stops, etc. In a preferred embodiment, the laces can extend through an opening in an outer shell, for instance, into a pouch of the outer shell so that the lace ends can be manipulated when the coat is on the wearer. This may provide for loosening and tightening of the compression zone without removing, or even opening, the outer shell of the coat.

Figure 2:
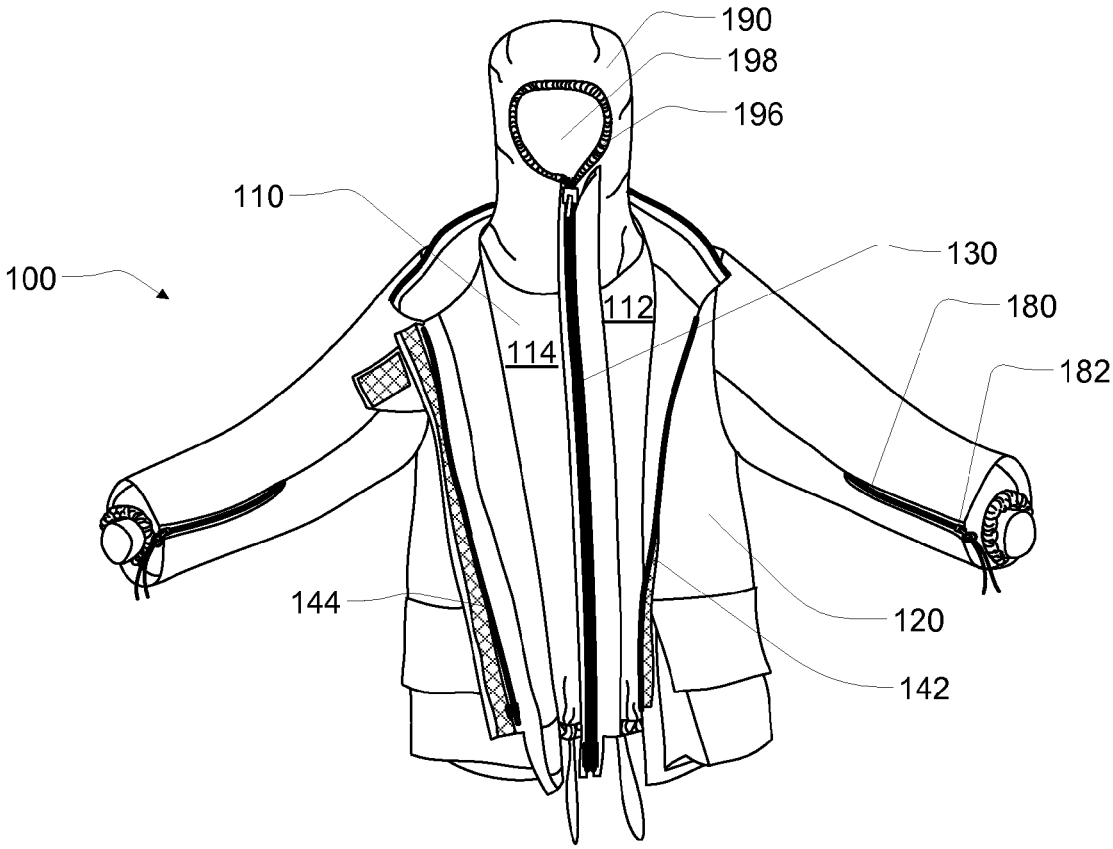
FIG. 2 provides a frontal view of a responder's coat including a liner and a deployed hood.
Figure 3:
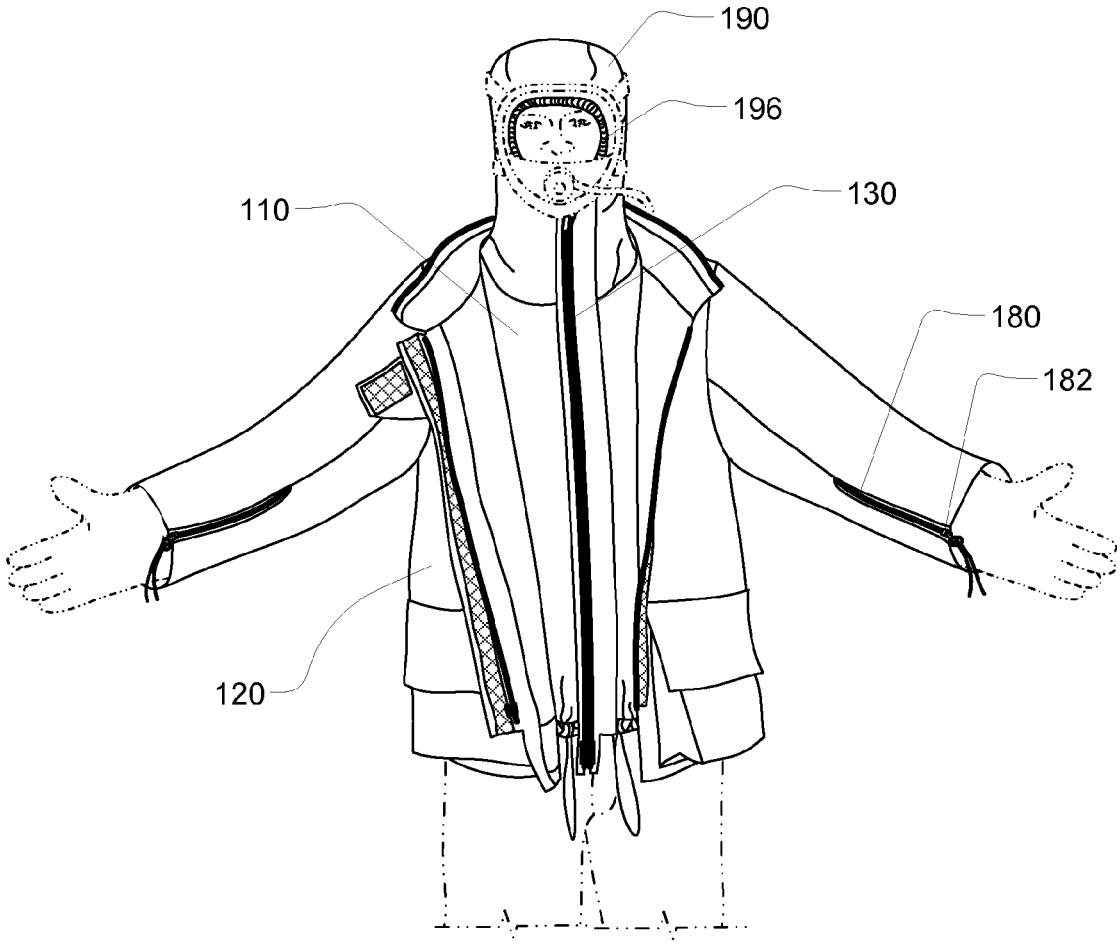
FIG. 3 provides a view of the coat of FIG. 2 fitted around a responder's gear, FIG. 4A provides a cross-sectional view of a collar portion of a responder's coat with a liner hood deployed.

FIGS. 1, 2 and 3 provide a view of one aspect of a coat 100 that may include both a liner 110 and an outer shell 120. Outer shell 120 may be flame, water and/or abrasion resistant and may be made from known materials used to make outer shells, such as meta and para-aramids (NOMEX and KEVLAR), polybenzimidaxazole (PBI) and blends thereof. For example, see FIRE PROTECTIVE COAT WITH FREE HANGING THROAT TAB, U.S. Pat. No. 6,934,970, which is incorporated by reference herein.

Liner 110 may include any of a moisture barrier, a thermal layer and/or a resistant barrier layer that may be vapor/liquid resistant. The resistant barrier layer of the liner may be breathable (selectively permeable) or impermeable to water. A resistant barrier layer can function by preventing or retarding hazardous substances such as toxic chemicals, chemical warfare agents and biological pathogens from reaching the skin of the responder. The barrier layer is typically one of two different types. A first type of barrier layer functions by repelling substances such as liquids and vapors. For example, the barrier layer may prevent the passage of a particular compound by exhibiting pore sizes that exclude a compound from passing through. A second type of barrier layer functions by adsorbing a substance rather than excluding it. For example, the barrier layer may include an adsorbent, such as activated carbon, that prevents the passage of undesirable substances by causing the substances to adhere to the adsorbent. In this manner, the substance may not be repelled by the barrier but is prevented from reaching the skin of the responder.

The resistant barrier layer may be made of any material or combination of materials that prevents or inhibits liquids and/or vapors from penetrating the liner. The resistant barrier layer may be formed from woven and/or non-woven materials such as membrane films and in some embodiments may be permeable to water vapor. The barrier layer may include one or more layers, for example, the barrier layer may be a laminate comprising a backing material or support layer laminated to a layer of semi-permeable membrane material and may also include an abrasion resistant material. The different layers may be affixed together by, for example, an adhesive. Some examples of polymers that may be useful as adhesives include polyurethane, natural latex rubber, nitrile rubber, silicone rubber, butyl rubber, fluorinated rubber, elastomeric copolymers, copolyether polyester, polyester, ethylene vinyl acetate or polyamide.

The resistant barrier layer or liner may include selectively permeable materials such as semi-permeable or "breathable" membranes that are water vapor permeable. Selectively permeable materials can include, for example, polyurethane, polytetrafluoroethylene (PTFE), polyester, polyether, polyamide, polyacrylate, copolyether ester and copolyether amides. Some preferred breathable membranes include expanded PTFE such as described in U.S. Pat. No. 4,187,390, incorporated by reference herein. Other materials that may be used in one or more layers of a resistant barrier liner include aramids such as NOMEX™ and para-aramids such as poly para-phenyleneterephthalamide. Additional materials that can be used in resistant barrier layers are described in U.S. patent application Ser. No. 10/440,147, titled COMPOSITE NONWOVEN FABRIC FOR PROTECTIVE CLOTHING AND PRODUCTION METHOD THEREOF, published as 2004/0176009 and in U.S. patent application Ser. No. 10/513,738, titled BREATHABLE ARTICLES, published as 2005/0176331; both of these applications are incorporated by reference herein.

Liner 110 may be shaped and constructed similarly to a conventional jacket, pullover, anorak, or coat, having two sleeves, a torso section and a collar. When equipped with a resistant barrier layer the layer should incorporate enough of the liner that hazardous vapors, liquids and aerosols are prevented from contacting the wearer. In some cases, the resistant barrier layer may be adequate to provide a level of protection to meet NFPA standard 1971.

As shown in FIGS. 1, 2 and 3, liner 110 may include left front portion (panel) 112 and right front portion (panel) 114. These portions may be joinable by a fastener such as zipper halves 132 and 134. The fastener may be vapor/liquid resistant. Fasteners, as used herein, can include, for example, hook and loop (VELCRO), snaps, buttons, zippers, slides and/or combinations of these. The opening between front portions 112 and 114 need not extend the full length of the liner and may extend, for example, half way or less from the neck down, resulting in a pullover type design. The liner may include an integral or removable thermal liner 115 for applications benefiting from improved thermal resistance.

Liner 110 may include hood 190 (FIGS. 2 and 3) that is connected to the torso portion of the liner. Hood 190 may be permanently attached (integral) to the liner (FIGS. 4A and 5) or may be attached via a reversible fastener (modular). The hood may be of the same material as is the liner or may be different. For example, the hood may be impermeable while the torso and/or sleeves of liner 110 are breathable. Impermeable fabrics include, for example, forms of polyvinyl chloride (PVC), polyurethane, nylon, polypropylene and synthetic and natural rubber. When not deployed, hood 190 may be stored in space between liner 110 and outer shell 120. Although a pocket or storage area may be added, the hood may slide comfortably between the liner and the shell, being hidden and almost unnoticeable by the wearer.

Zipper halves 132 and 134 may extend from the torso area of the liner to the hood. Thus, when the hood is deployed, the fastener may be fully closed providing protection that extends from the waist up to the face, to a level where the hood can form a vapor/liquid resistant seal with an SCBA facemask. When the hood is not deployed, the fastener halves may not be fully connected, and when the coat is donned, may be connected or closed up to a spot just below the chin. Fastener halves may be disconnected from each other at a point near the top of the wearer's sternum and, as can be seen in FIG. 1, each fastener half may track independently to the right and left until it tucks into collar 160.

Coat collar 160 may include two or more portions. For instance, coat collar 160 may include liner collar 164 connected to shell collar 162. Thus, each of liner collar 164 and shell collar 162 may provide half of coat collar 160. The halves may be joined by a fastener, such as zipper 170, that can include zipper half 172 (FIG. 4A), attached to liner collar 164 and zipper half 174 (FIG. 5) attached to shell collar 162. When zipper halves 172 and 174 are joined and hood 190 is undeployed, the hood may drop downwardly from its point of attachment to liner 110 and fall between the back outer surface of the liner and the back inner surface of shell 120. When collars 162 and 164 are joined together, this union can serve to connect liner 110 to shell 120. There need not be any other connection between the two, although other fasteners, for example in the sleeves or torso area, may be used to secure the liner to the shell. Shell 120 may include shell zipper halves 142 and 144 and may also include flap 146 that can help to seal the zipper through the use of a hook and loop fastener.

Liner collar 164 may be joined to the liner on the inner surface of the liner rather than the outer surface as with conventional hoods. Thus, when in a deployed position hood 190 may surround a portion or all of the collar and, in this case, liner collar 164 may be obscured by the hood, and when the hood is drawn up around an SCBA mask (FIG. 3), liner collar 164 may not be visible to an observer. In this case, liner collar 164 need not provide any specific protection to the wearer and may be made of any appropriate material, preferably a material that is comfortable to the wearer. Such materials include, for example, natural and synthetic fibers such as synthetic fleece or terrycloth. The collar may also include trim portion 166 that may be of a material identical or similar to that of shell collar 162, providing a look of continuity when the two coat collar halves are joined together. Trim portion 166 may also make it easier for a user to orient the liner in relation to the shell when the two are to be joined.

Figure 4A:
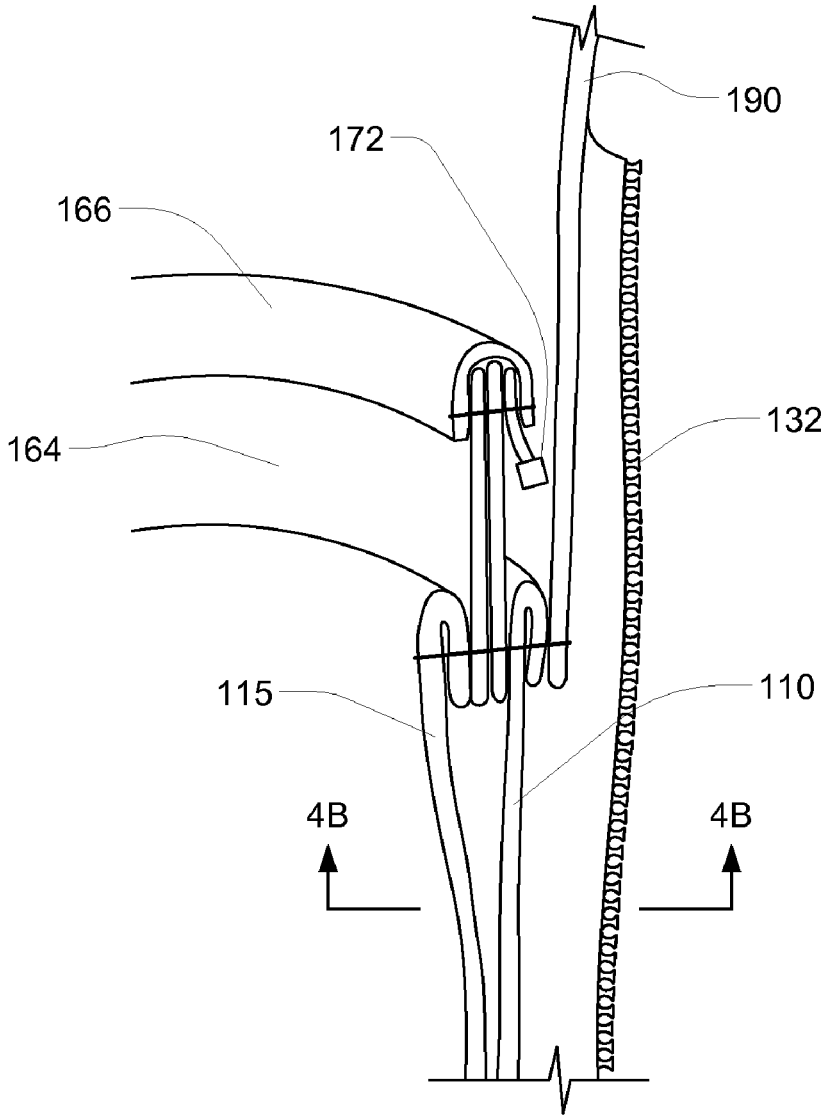
FIG. 4B provides a cross-section view along line 4B of FIG. 4A.
Figure 4B:
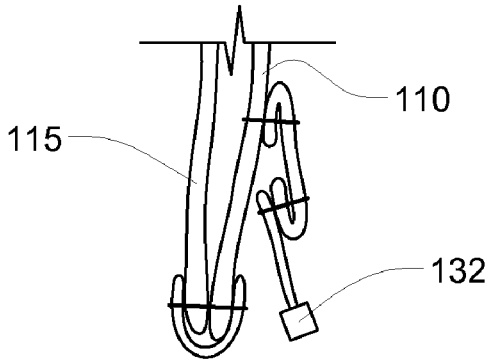
Figure 5:
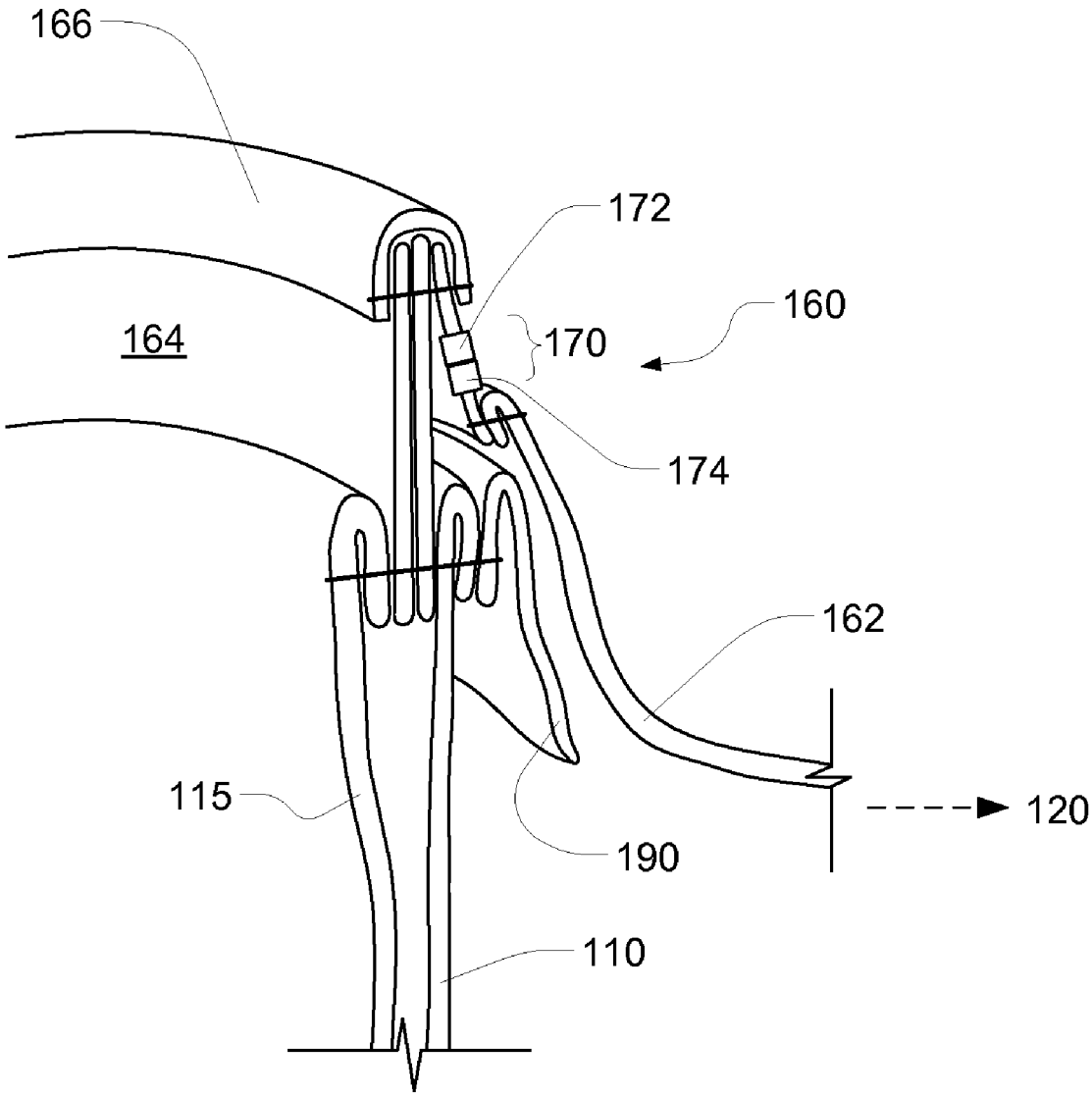
FIG. 5 provides a cross-sectional view of a collar portion of a responder's coat, with a liner hood undeployed.

Although a central space may be formed in coat collar 160 when collar halves 162 and 164 are joined, the hood is typically not stored in this space. Collar 160 can retain a natural collar shape and in some cases may look like a conventional collar to an observer. When a hood is stored in a collar the collar can get bulky, uncomfortable and can lose its shape. In most embodiments the hood can be stored flat in the large space between the liner and the back of the shell, typically requiring no bunching or rolling. This can provide for greater comfort and a more natural look. When the hood is undeployed, the wearer may not even feel that it is there. FIGS. 4A, 4B and 5 provide a cross-sectional view of an embodiment of the collar and some of its related components. FIGS. 4A and B show the garment with hood 190 deployed, extending upward from its point of attachment at liner 110. Fastener half 172 can be disconnected from fastener half 174 (not shown in FIG. 4), allowing the hood to be withdrawn from the space between liner collar 164 and shell collar 162. Zipper half 132 can be fully extended and can be joined with complementary zipper half 134 to provide a vapor/liquid resistant seal up to an SCBA mask, or similar. In FIG. 5, hood 190 is undeployed and is stored downwardly in a space between liner 110 and shell 120. Zipper halves 172 and 174 form closed zipper 170 and securely join liner collar 164 and shell collar 162 to form collar 160. This connection can also secure the liner to the shell. In this configuration, hood 190 is visible from neither the shell exterior nor the interior of the liner, thus providing the appearance of, for example, traditional firefighter turnout gear. Collar trim portion 166 may be made of, or covered with, material similar to that of shell 120.

As shown in FIG. 2, hood 190 may include sealing interface 196 designed to provide a vapor/liquid resistant seal when used in conjunction with an SCBA mask. The interface may be sized and shaped for a particular brand and model of mask. The interface may include a channel sewn into the periphery of face opening 198. An elastic, drawstring or other tightening device may run through the channel to provide a method of tightening the hood interface around the mask.

Preferably, the tightening device should provide enough tension to form a vapor/liquid resistant seal around the mask while also not being so tight that the wearer cannot fit the opening around the mask or has difficulty in fastening fastener 130 up to mask level. In some embodiments, the seal may be sufficient for meeting the requirements of NFPA standard 1971.

FIGS. 7A-D illustrate another aspect of the invention directed to a coat liner including a compression zone. The compression zone can reduce the amount of air space between the inner surface of a coat liner and the wearer's body. Any air contained in this space can be exchanged with air containing hazardous materials when the wearer is working in a hazardous zone. The wearer's movement can cause compression and subsequent expansion of these areas resulting in expulsion and admission of gases. If the admitted gases are hazardous or carry hazardous materials, injury may result. By reducing the volume of this airspace, a compression zone can reduce or eliminate the infiltration of these hazardous gases.

In many embodiments a compression zone may be adjustable over a range to allow for comfort and, ease of movement in conditions where full compression may not be needed. An adjustable compression zone may allow the garment to be worn by responders of different sizes and can be adjusted over the long term to any changes in the girth of the wearer.

Figure 7A:
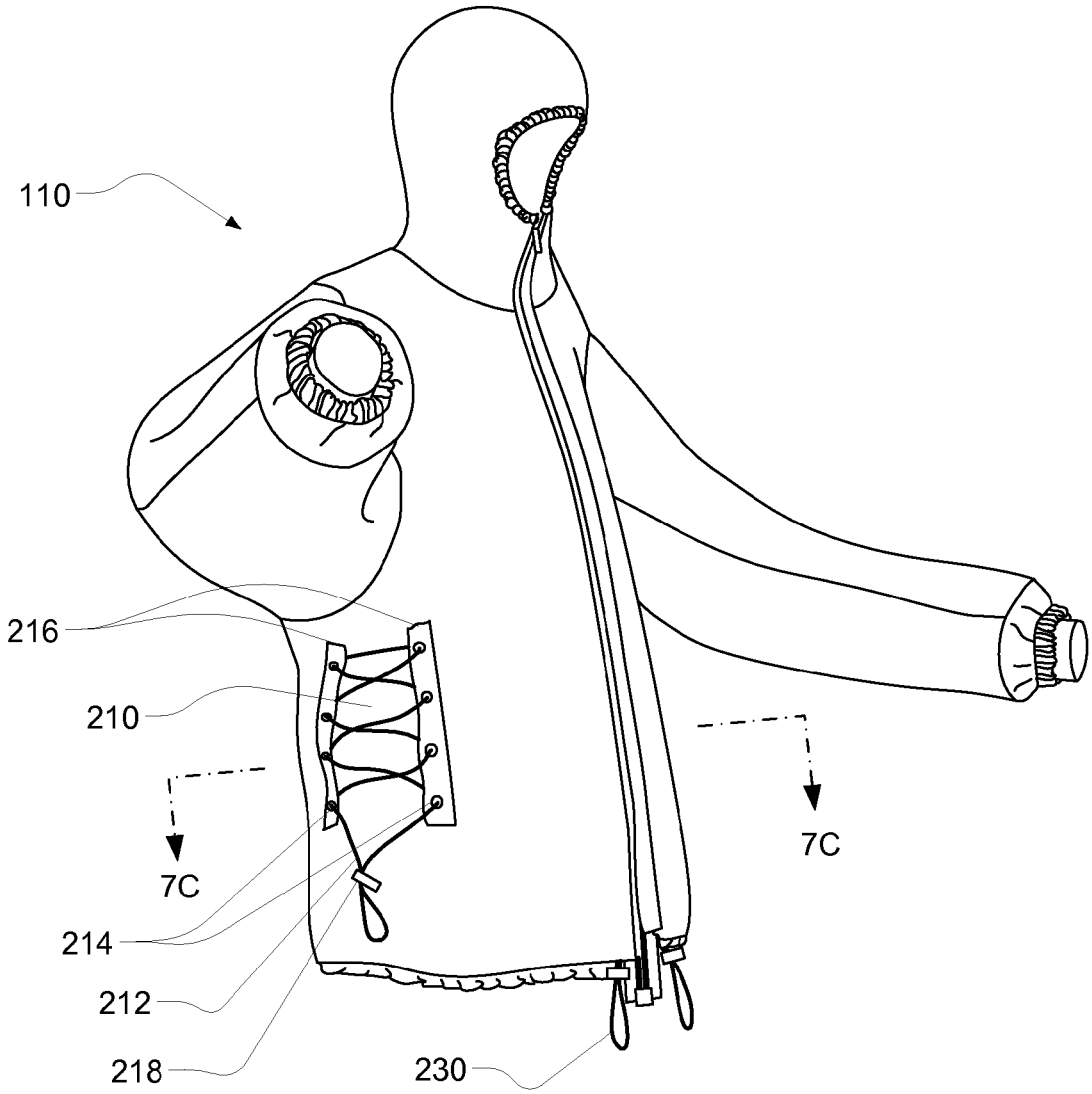
FIG. 7A provides a perspective view of a compression zone of a coat liner.
Figure 7B:
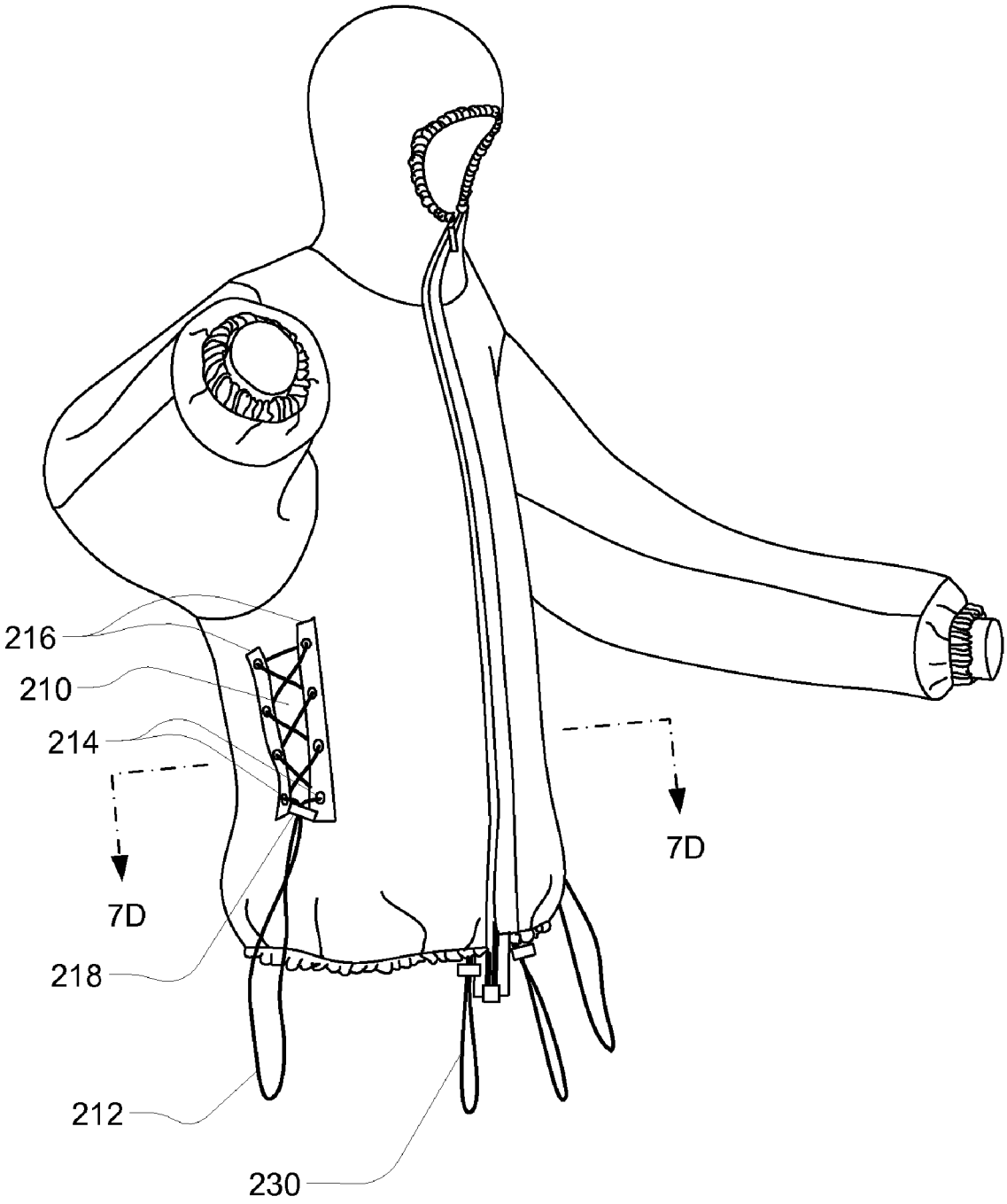
FIG. 7B provides a perspective view of a compression zone of a coat liner.

A compression zone may be placed anywhere on the liner where it can function to reduce liner volume. As shown in FIGS. 7A-D, compression zone 210 may be conveniently formed on the side of the liner, generally in the kidney area of the wearer. This positioning provides for a large amount of volume reduction as this torso region of the liner is typically where a large air space forms. The compression zone may be above a waist region and below the portion of the liner where the sleeves join the front and rear panels. The compression zone may function via any number of appropriate mechanisms, including, for example, lace and eyelet, hook and loop tabs, zippered tabs, snaps, buttons, or a girdle-style belt. As shown in the figures, the compression zone may include lace 212, eyelets 214 and compression tabs 216. Tabs 216 may be joined to the liner using conventional techniques such as sewing, taping, or ultrasonic welding. When the tabs are drawn toward each other, the effective circumference of the liner is reduced, resulting in less air volume between the liner and the wearer's skin. The tabs may include a series of eyelets 214 through which one or more laces 212 are threaded. When the laces are pulled, the tabs are drawn together to reduce the circumference and thus the volume of the liner. The number of eyelets can be any number, usually in pairs, such as two, four, six, eight or more, and typically eyelets are paired up with an eyelet on the opposing tab. When a lace and eyelet compression zone is undergoing tightening and a threshold resistance is achieved in the region of an eyelet pair (the liner is snug), other eyelet pairs may be constricted to a greater degree, allowing for a variation in the amount of circumference reduction throughout the length of the compression zone. For example, FIG. 7B provides a view of a liner after the compression zone has been tightened and shows that the eyelets in the lower region of the zone are more constricted than those in the upper region.

Figure 6:
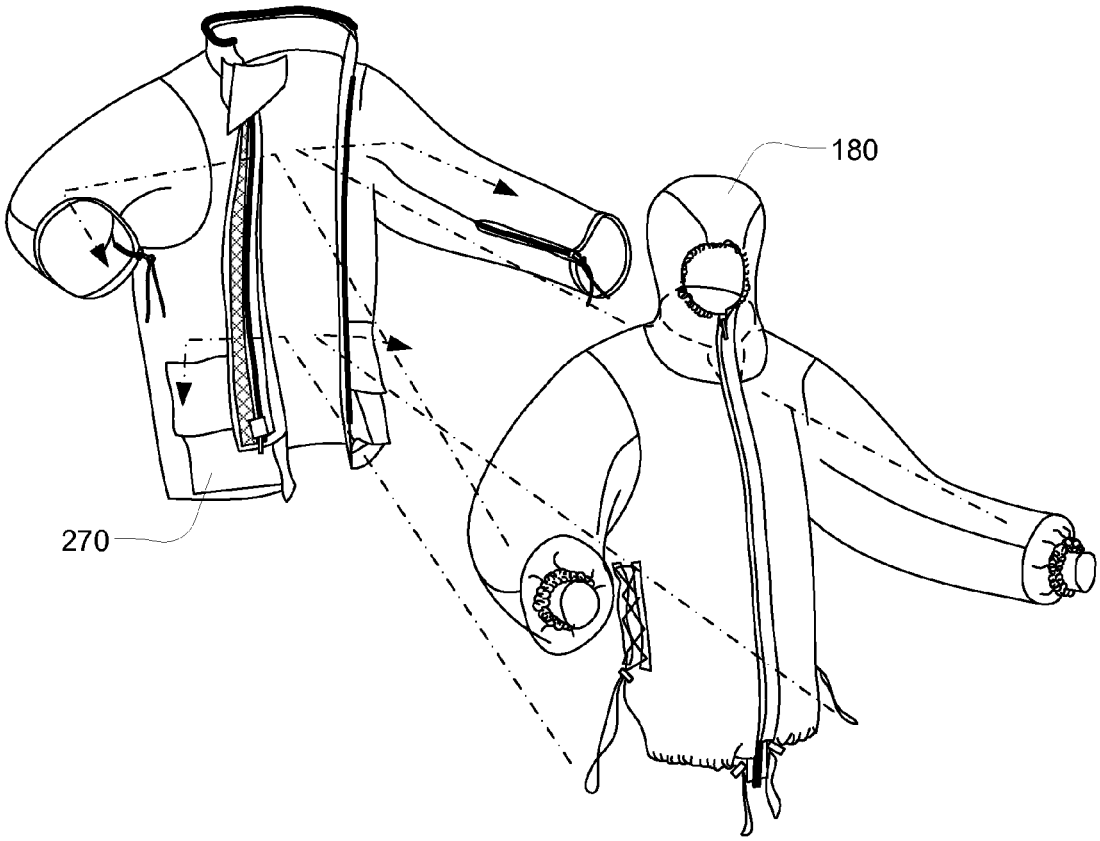
FIG. 6 provides an exploded view illustrating how a liner may fit into an outer shell to form a responder's coat.

The laces may be tightened and secured by tying or with a closure, such as a cord lock that is used for outdoor gear. The closure may be tightened before or after the outer shell is donned and the liner and shell may be donned together as a single coat unit. In some embodiments the laces may pass through an opening in at least one shell layer so that, for example, the laces can be tightened by the user after donning the coat. In a preferred embodiment, the laces pass through opening 260 (FIGS. 7C and 7D) into pouch 270 (FIGS. 1 and 6). In this case, the compression zone can be tightened by reaching into the pouch and pulling on the laces. Any amount of the laces extended as a result of tightening can be stored in the pouch to avoid tangling and interfering with work. The pouch of the coat may also be equipped with a small internal pocket, typically sewn to the shell material inside the pouch that can be used to retain the laces. A closure, such as slide lock 218, can reside, for example, either in the space between the shell and the liner or, alternatively, in the pouch or other region that is external of the shell. In some cases, the pouch interior may include an integral closure through which the laces can pass after the liner and shell are donned or when they are nested to form the coat. The laces can also serve as a point of connection between the liner and the shell.

Figure 7C:
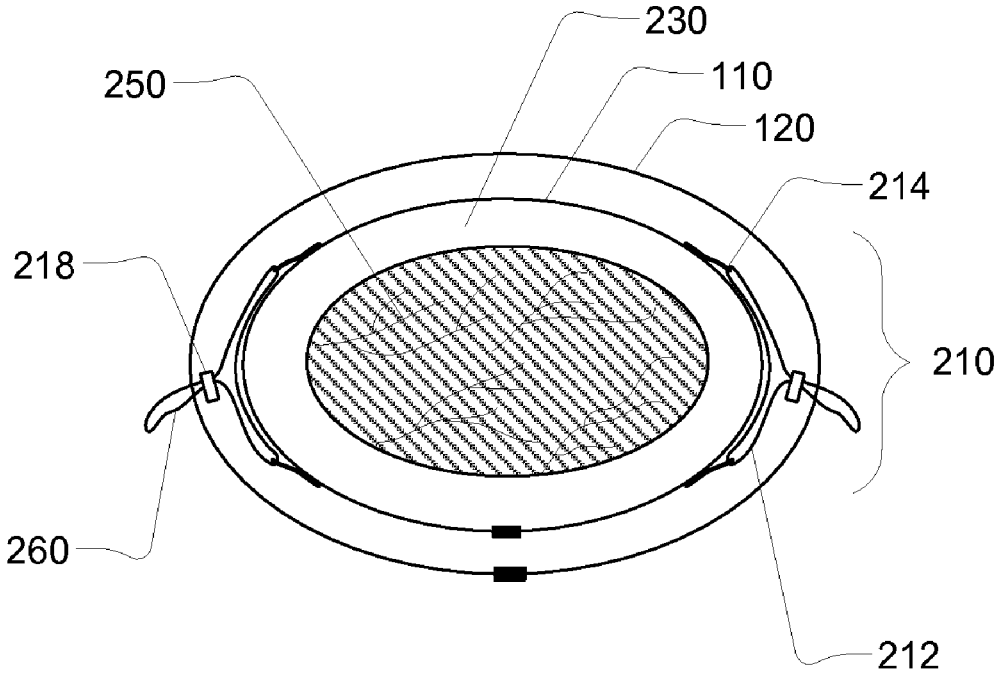
FIG. 7C provides a cross-sectional view along line 7C of FIG. 7A.
Figure 7D:
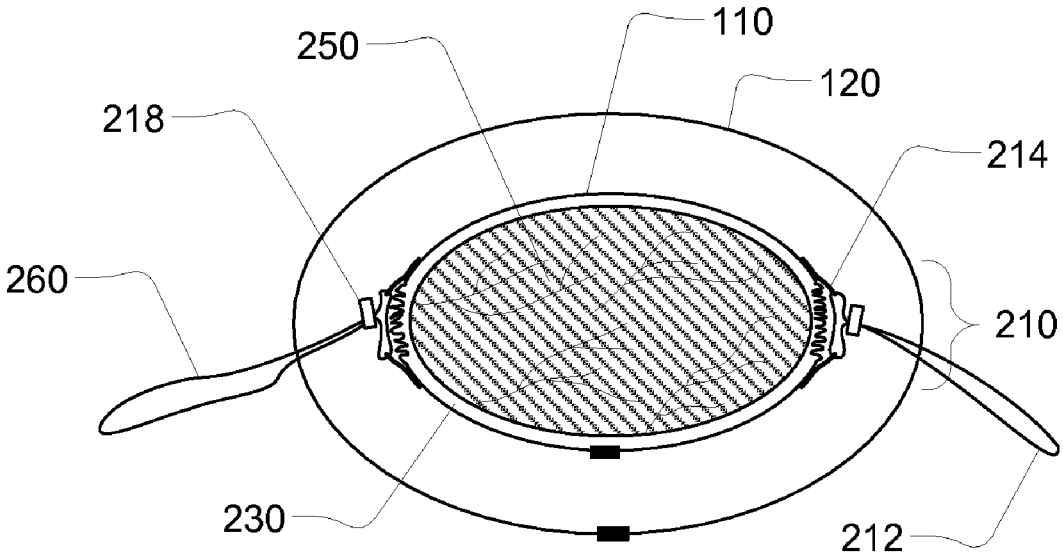
FIG. 7D provides a cross-sectional view along line 7D of FIG. 7B.

FIG. 7C illustrates the amount of airspace 230 that may be present around the wearer's torso 250 when the compression zone is in a relaxed state. FIG. 7D illustrates the volume decrease in airspace 230 that can occur upon tightening of the compression zone.

Figure 8:
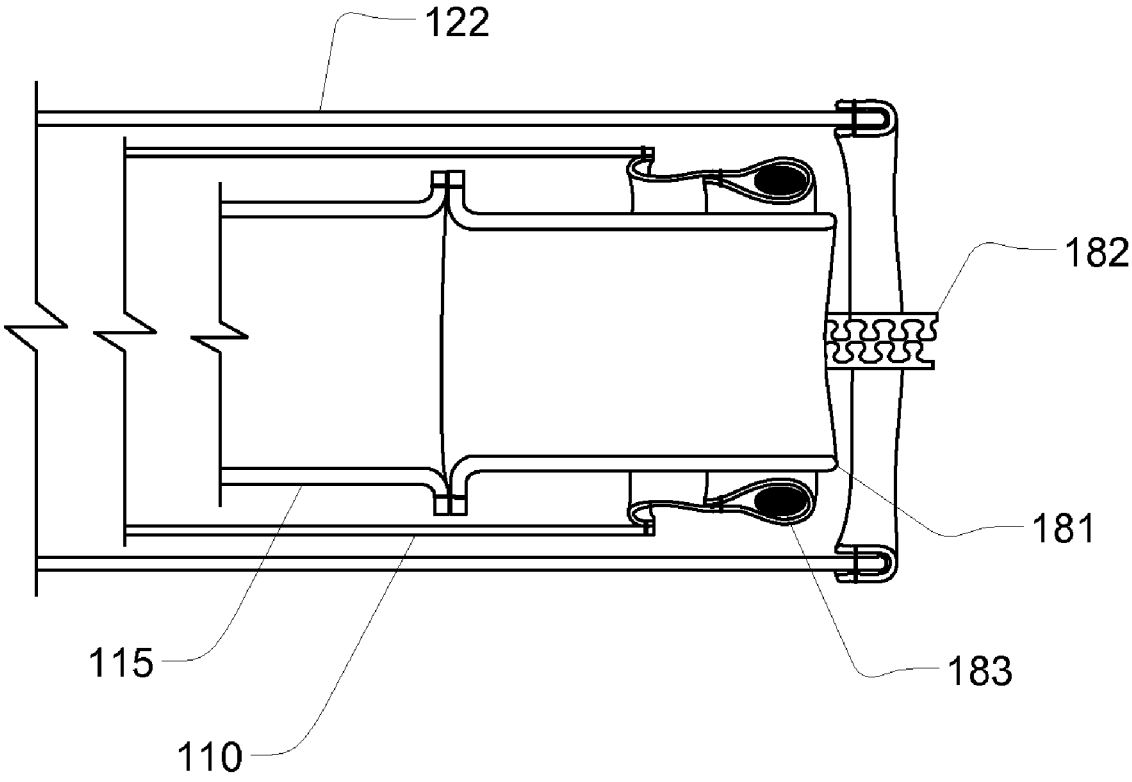
FIG. 8 provides a cut-away view of one embodiment of a sleeve of a responder's coat.
Figure 9:
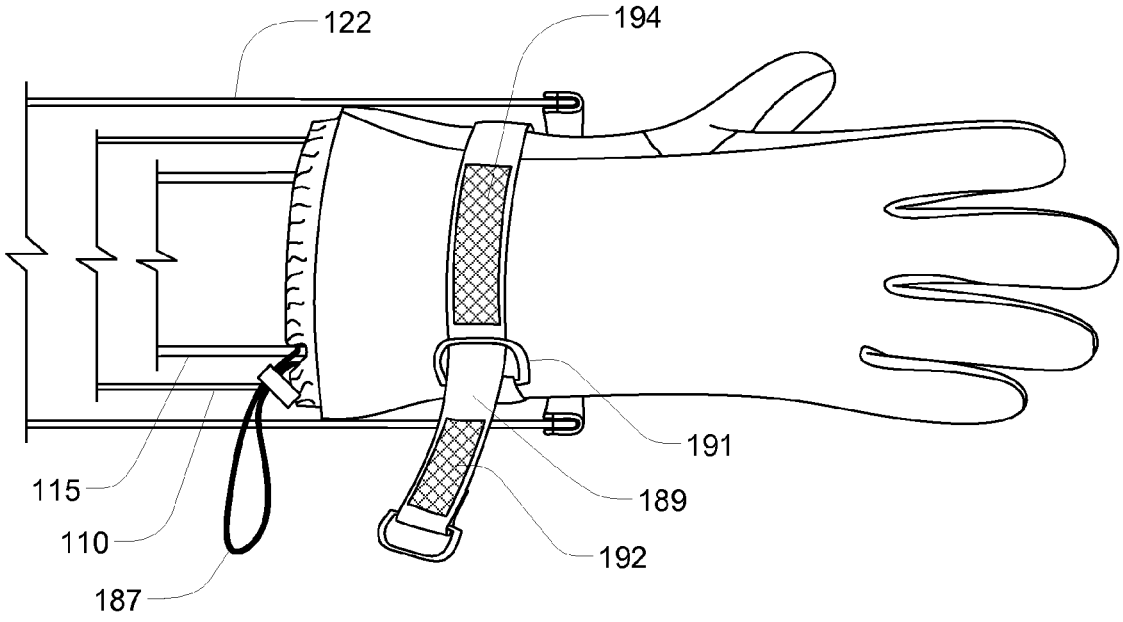
FIG. 9 provides a view of the sleeve of FIG. 8 showing the positioning of a glove.
Figure 10:
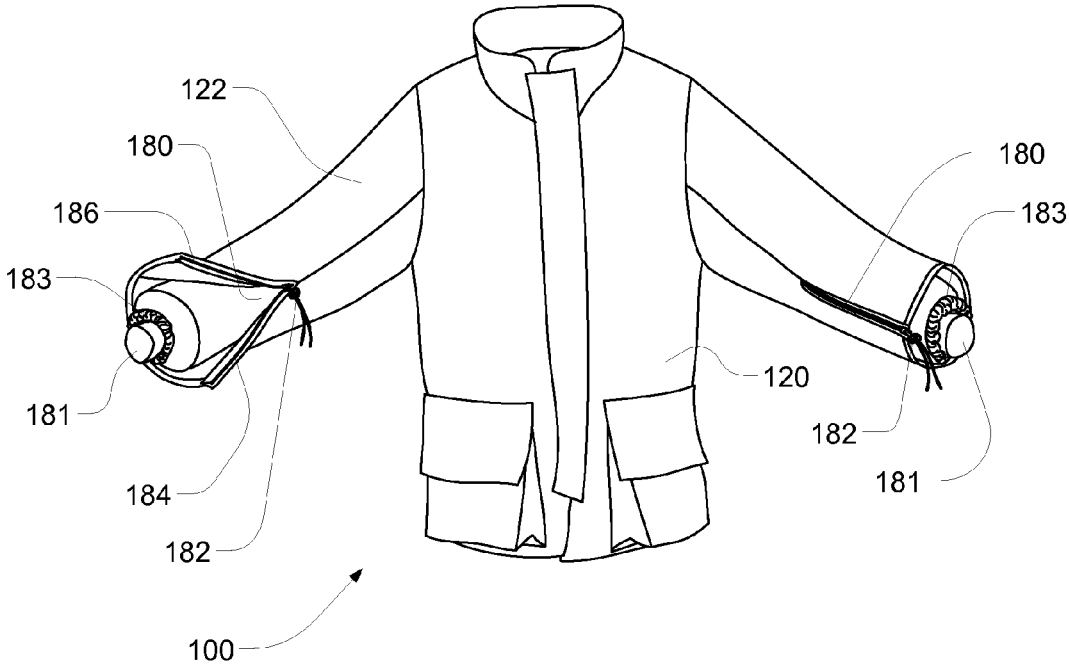
FIG. 10 provides a frontal view of one embodiment of a responder's coat of the invention.
Figure 11:
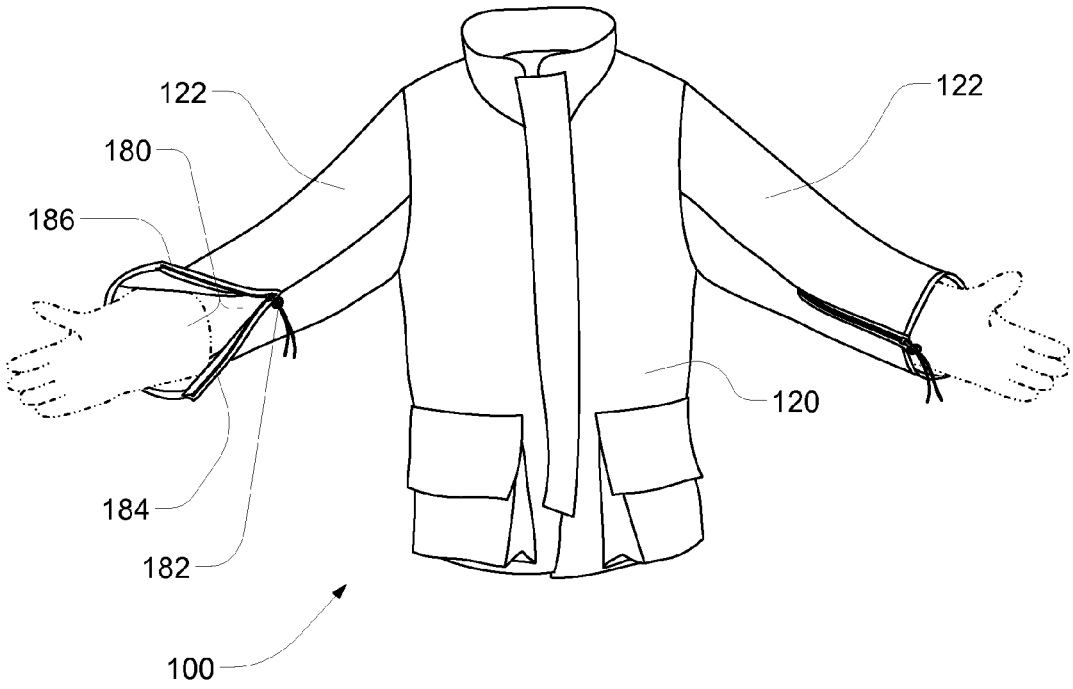
FIG. 11 provides a frontal view of one embodiment of a responder's coat of the invention.

Another aspect of the invention is illustrated in FIGS. 8-11. FIGS. 8 and 9 provide cut away views of a coat sleeve; FIG. 8 without a glove and FIG. 9 including a glove. Similarly, FIGS. 10 and 11 show frontal views of responder coats including the sleeves shown in FIGS. 8 and 9. Each sleeve in shell 120 of coat 100 shown in the figures can include a slit 180, or a separation, in the sleeve material that can allow the sleeve to be opened up from the wrist end. This can facilitate, for example, the donning of a glove. Slit 180 may be closeable and openable via fastener 182 that may be, as shown here, a zipper, although any appropriate fastener can be used. Other embodiments may use, for example, fasteners such as hook and loop (VELCRO), snaps and buttons. Fasteners may be vapor/liquid resistant. In preferred embodiments, the fastener may be flame resistant and water resistant and may pass one or more of NFPA standards 1951, 1971, 1992, 1999, and 1994. A flap or tab of waterproof and/or flame resistant material can back up the fastener, providing an increased ability to shed water and reduce the infiltration of hazardous materials. Preferably, the slit should open to an extent where it facilitates the donning of a gauntlet style glove. For some gloves, a slit in the shell sleeve may be greater than about 6, 8, 10 or 12 inches long. As shown in FIGS. 10 and 11 the slit may run along a seam of the sleeve, and the fastener may be sewn into the sleeve during manufacture. The glove may include a liquid barrier, a vapor/liquid resistant layer such as a resistant barrier layer and/or a flame resistant layer. The vapor/liquid resistant layer may be impermeable or semi-permeable (breathable). The gauntlet portion of the glove (between the thumb and glove opening) may be greater than 3, 4, 5 or 6 inches in length. This glove and liner combination may be part of an ensemble that meets the requirements of NFPA standard 1971.

Figure 12:
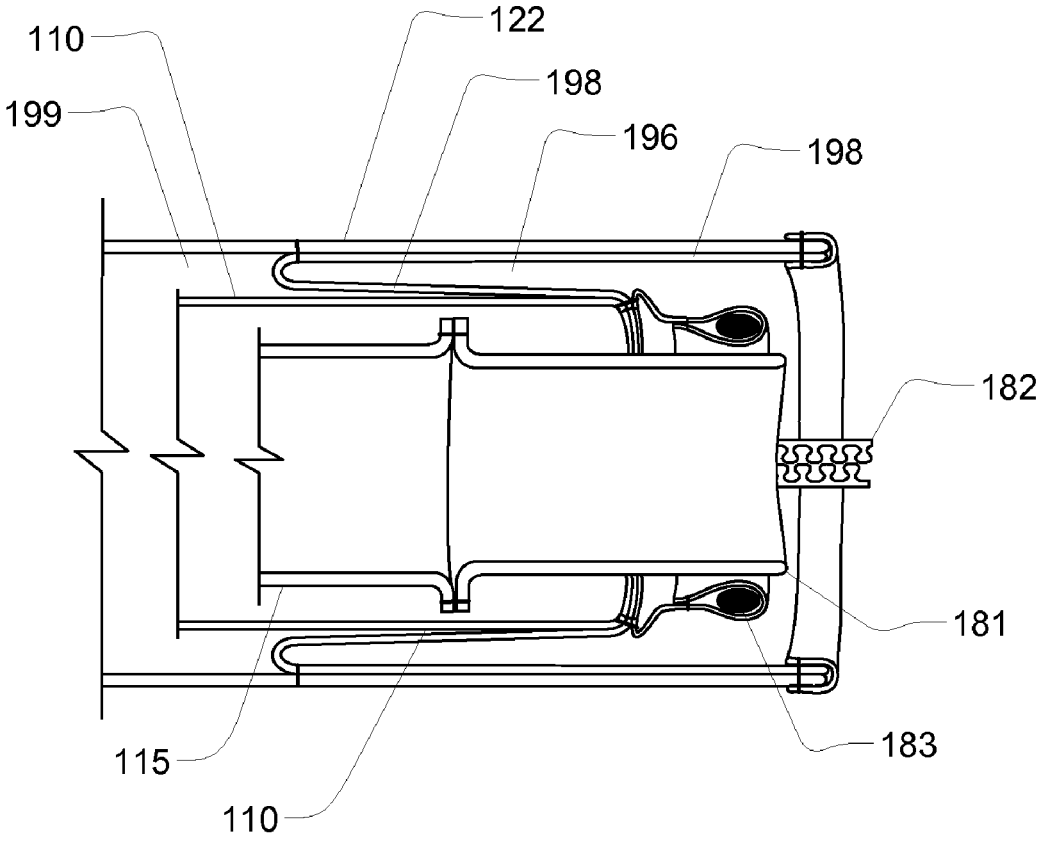
FIG. 12 provides a cut-away view of another embodiment of a sleeve of a responder's coat.
Figure 13:
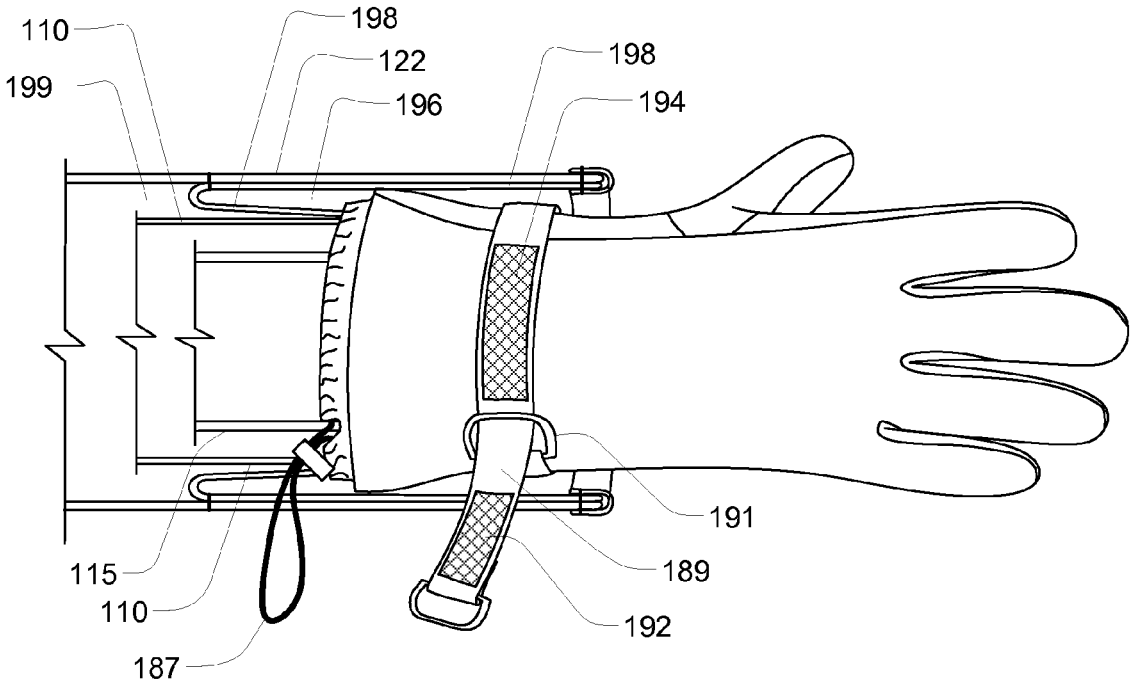
FIG. 13 provides a cut-away view illustrating the positioning of a glove in the embodiment shown in FIG. 12.
Figure 14:
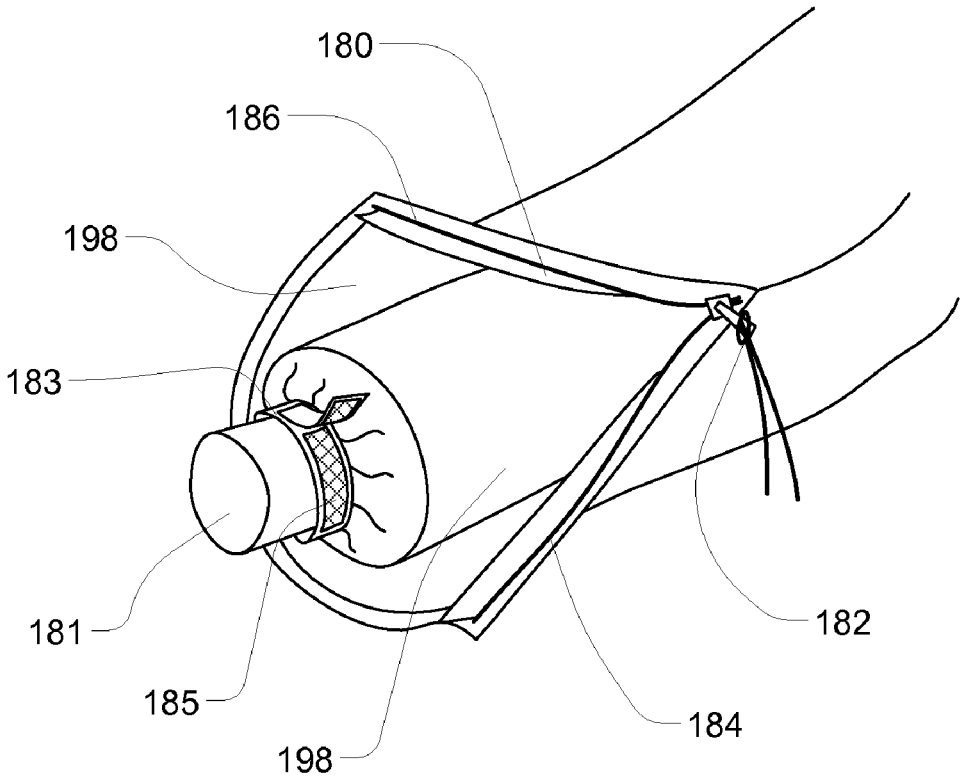
FIG. 14 provides a perspective view illustrating a sleeve and cuff of another embodiment of the invention.

In another embodiment, illustrated in FIGS. 12-14, a responder coat may include a sleeve having a "water well." As seen in the cross-sectional view shown in FIG. 12, the sleeve may include an outer shell sleeve 122 having a slit that is sealed by fastener 182. Thermal liner 115 may be terminated by wrister 181 and liner 110 may be terminated by elastic cuff 183. The barrier layer may be, for example, a moisture barrier, a vapor/liquid resistant barrier, and/or a resistant barrier layer. Liner 110 may be independent, may be affixed to outer shell sleeve 122 or may be affixed to thermal liner 115. Water well 196 may be formed by liner tube 198, part of which may be folded back on itself (inside out) as shown in FIGS. 12 and 13. The portion of liner tube 198 that is adjacent to outer shell sleeve 122 may include a slit that corresponds to slit 180 in shell sleeve 122. Liner tube 198 may be, for example, a moisture barrier, a vapor/liquid resistant barrier and/or a resistant barrier layer. Liner tube 198 may be made of a material that is the same as or is different from the material of which liner 110 is made. Liner tube 198 may be permanently attached to liner 110 and/or to outer shell sleeve 122. This may form a liquid and/or vapor barrier between water well 196 and space 199. Liner tube 198 may also connect liner 110 to shell 120.

The water well may aid in preventing the transport of substances from the environment into the sleeve and from the sleeve into the glove. For instance, if the responder is working with hands up in the air, water and other liquids may flow over the glove and back into the sleeve. Liner tube 198 can prevent that material from traveling any further than water well 196. In other cases, liquids may penetrate outer shell 120 above the wrist allowing these materials to enter space 199. While liner 110 may, by itself, protect the responder from contact with these liquids, the materials may flow down the outside of the liner and, absent a water well, may in some cases breach the interface between the liner and the glove, allowing this liquid to contact the hand. Liner tube 198 can prevent this downward flow into the glove, providing a liquid-proof barrier and added protection to prevent entry of liquids into the glove.

FIG. 14 provides a perspective view of a sleeve embodiment that may include a water well. The water well can be defined by liner tube 198 that may be joined to a liner at elastic cuff 183 and may be joined to the outer shell at the wrist. This may provide a liquid barrier separating the lower and upper parts of the sleeve. Preferably, the water well is about as deep as is slit 180. Using this design, the gauntlet portion of a gauntlet glove may be pulled up into the water well after opening fastener 182. Slit 180 can then be closed by closing fastener 182. Elastic cuff 183 may include fastener 185 that may aid in securing a tighter fit between the liner and the responder's wrist. Fastener 185 may be, for example, a hook and loop type fastening system.

In hazardous materials embodiments, a glove should be able to form a vapor/liquid resistant seal with a liner of coat 100. As shown in FIG. 9 the liner may include elastic wristers 181 and elastic cuff 183. The gauntlet portion of the glove can include a drawstring 187 that encircles the opening of the glove cuff. Preferably, the gauntlet is of a diameter to fit over the sleeve of the liner and under the sleeve of the shell. In an alternative embodiment shown in FIG. 13 the gauntlet portion of the glove can fit within water well 196 of the coat sleeve. After donning the glove, slit 180 in the shell sleeve can provide access to the drawstring so that the drawstring can be cinched around the sleeve of the liner. This can form a vapor/liquid resistant seal. A second seal can be formed by tightening strap 189 that encircles the glove in the area of the wrist. The strap may pass through a ring or loop 191, for instance, and circle back on itself to be joined by opposing faces 192 and 194 of hook and loop fasteners. Preferably the strap is tightened over an area of the wrist to which the sleeve of the liner (or water well) extends. After the drawstring is tightened and the strap tightened, slit 180 may be sealed by closing fastener 182. By tightening the glove over the liner, this strap provides a second vapor/liquid resistant interface between glove and liner, resulting in a barrier against intrusion of hazardous liquids, vapors and aerosols. The gloves may be used with an appropriate coat, trousers and boots to provide full body protection against harmful chemical agents and biological pathogens.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined.

All patents, patent application publications and documents cited herein are hereby incorporated by reference.

What is claimed is:

1. A resistant barrier coat for protecting against chemical and/or biological hazards, the coat comprising:

a flame and abrasion resistant outer shell, the outer shell including a torso portion, two sleeve portions and a collar portion;

a resistant inner barrier liner including a torso portion, two sleeve portions, an integral hood, and a collar portion mounted on an inside surface of the resistant barrier liner; and a means for removably connecting the collar portion of the resistant inner barrier liner to the collar portion of the outer shell whereby the integral hood is stored in a space between the outer shell and the resistant inner barrier liner and concealed by the connecting means within the space between the outer shell and the resistant inner barrier liner when the outer shell and resistant inner barrier liner are connected and is accessible for deployment as a hood and retrievable from the space between the outer shell and the inner resistant barrier liner when the means for removably connecting is unconnected.

2. The resistant barrier coat of claim 1 wherein the resistant barrier liner is connected to the outer shell only at the collar portion of each.

3. The resistant barrier coat of claim 1 wherein the means for removably connecting is unattached when the hood is in a deployed position and wherein the fastener is attached when the hood is undeployed.

4. The resistant barrier coat of claim 1 constructed and arranged to place the hood, alternately, in at least a deployed position and an undeployed position, wherein when the hood is in the deployed position the liner is not attached to the outer shell at the collar portions.

5. The resistant barrier coat of claim 4 wherein the liner is attached to the outer shell at the collar portions when the hood is in an undeployed position.

6. The resistant barrier coat of claim 1 wherein the liner comprises a material selected from the group consisting of urethanes, PTFE, neoprene, natural and synthetic rubber, para-aramids, and polyamides.

7. A firefighter's ensemble that complies with at least one of NFPA Standards 1951, 1971, 1992, 1999, and 1994, the ensemble comprising the resistant barrier liner of claim 1.

8. A resistant barrier liner for use as part of an emergency responder's coat, the liner comprising:

a breathable resistant inner barrier layer including a collar portion mounted on an inside surface of the resistant barrier layer;

an integrated hood formed from the resistant inner barrier layer; and a means for removably connecting the collar portion of the resistant inner barrier layer to a collar portion of an outer shell of the coat whereby the integral hood is stored in a space between the outer shell and the resistant inner barrier layer and concealed by the connecting means within the space between the outer shell and the resistant inner barrier layer when the outer shell and resistant inner barrier layer are connected and is accessible for deployment as a hood and retrievable from the space between the outer shell and the inner resistant barrier layer when the means for removably connecting is unconnected.

9. The resistant barrier liner of claim 8 wherein the barrier layer comprises a material selected from the group consisting of urethanes, PTFE, neoprene, natural and synthetic rubber, para-aramids, and polyamides.

10. The resistant barrier liner of claim 8 wherein the liner comprises a front left panel, a front right panel, and a vapor resistant fastener for joining the left panel to the right panel.

11. The resistant barrier liner of claim 10 wherein the means for removably connecting is constructed and arranged to extend from below the responder's waist to beyond the responder's chin.

12. The resistant barrier liner of claim 8 further comprising a thermal layer.

13. The resistant barrier liner of claim 12 wherein the thermal layer is permanently attached to the breathable resistant barrier layer.

14. A firefighter's ensemble that complies with at least one of NFPA Standards 1951, 1971, 1992, 1999, and 1994, the ensemble comprising the resistant barrier layer of claim 8.

* * * * *